US006512457B2

(12) United States Patent
Irizarry et al.

(10) Patent No.: US 6,512,457 B2
(45) **Date of Patent: *Jan. 28, 2003**

(54) MONITORING DEVICE ADAPTED FOR USE WITH AN ELECTRONIC ARTICLE SURVEILLANCE SYSTEM

(76) Inventors: Hector Irizarry, 600 Madison St., Hoboken, NJ (US) 07030; Philip M. Anderson, 37 Winding Way, Madison, NJ (US) 07940

( * ) Notice: Subject to any disclaimer, the term of this patent is extended or adjusted under 35 U.S.C. 154(b) by 0 days.

This patent is subject to a terminal disclaimer.

(21) Appl. No.: 09/748,416

(22) Filed: Dec. 26, 2000

(65) Prior Publication Data

US 2001/0004239 A1 Jun. 21, 2001

Related U.S. Application Data

(63) Continuation-in-part of application No. 09/439,689, filed on Nov. 15, 1999, now Pat. No. 6,195,009.

(51) Int. Cl.[7] ..... G08B 23/00

(52) U.S. Cl. ..... 340/573.4; 340/572.3; 340/571; 340/568.1; 340/551; 340/636; 340/693

(58) Field of Search ..... 340/573.4, 572.3, 340/571, 568.1, 551, 636, 693

(56) References Cited

U.S. PATENT DOCUMENTS

| | | | | |
|---|---|---|---|---|
| 4,118,693 A | * | 10/1978 | Novikoff | 340/572 |
| 4,274,090 A | * | 6/1981 | Cooper | 340/572 |
| 4,510,489 A | | 4/1985 | Anderson, III et al. | 340/572 |
| 4,598,272 A | | 7/1986 | Cox | 340/539 |
| 4,694,284 A | | 9/1987 | Leveille et al. | 340/574 |
| 4,785,291 A | | 11/1988 | Hawthorne | 340/573 |
| 4,812,811 A | | 3/1989 | Äsbrink et al. | 340/571 |
| 4,899,135 A | | 2/1990 | Ghahariiran | 340/573 |
| 4,992,776 A | | 2/1991 | Crossfield | 340/551 |
| 5,021,794 A | | 6/1991 | Lawrence | 342/457 |

(List continued on next page.)

FOREIGN PATENT DOCUMENTS

| | | | |
|---|---|---|---|
| DE | 3215942 | 11/1983 | |
| DE | 19608348 | 9/1997 | G08B/13/22 |
| EP | 323041 | 7/1989 | |
| FR | 2543715 | 10/1984 | |
| FR | 2608868 | 6/1988 | |
| FR | 2674351 | 9/1992 | G08B/3/10 |
| FR | 2704345 | 10/1994 | G08B/7/06 |
| GB | 1496945 | 1/1978 | G01S/9/56 |
| GB | 2182183 A | 5/1987 | G08B/13/24 |
| GB | 2218245 A | 11/1989 | G08B/13/00 |
| GB | 2248330 A | 4/1992 | G08B/21/00 |
| GB | 2248331 A | 4/1992 | G01S/13/88 |
| GB | 2276025 A | 9/1994 | G08B/21/00 |
| GB | 2279170 A | 12/1994 | G08B/13/14 |
| GB | 2291303 A | 1/1996 | G01S/3/48 |
| WO | WO 8703404 | 6/1984 | |
| WO | WO 8706748 | 11/1987 | |
| WO | WO 9607998 | 3/1996 | |
| WO | WO 9614625 | 5/1996 | G08B/13/14 |
| WO | WO 9618913 | 6/1996 | G01S/13/84 |
| WO | WO 9627173 | 9/1996 | |

*Primary Examiner*—Daniel J. Wu
*Assistant Examiner*—Tai T. Nguyen
(74) *Attorney, Agent, or Firm*—Ernest D. Buff & Associates; Ernest D. Buff; Gordon E. Fisk

(57) ABSTRACT

An apparatus monitors the movement of a person through an exit. The apparatus comprises an electronic article surveillance system adapted to generate an electromagnetic field at the exit and a tag worn by the person. The tag is responsive to the electromagnetic field. It is caused to alarm upon departure of the person from the exit. The tag is further provided with an alarm means for alarming the electronic article surveillance system.

18 Claims, 6 Drawing Sheets

U.S. PATENT DOCUMENTS

| | | | | | |
|---|---|---|---|---|---|
| 5,119,072 | A | | 6/1992 | Hemingway | 340/573 |
| 5,168,263 | A | * | 12/1992 | Drucker | 340/571 |
| 5,289,163 | A | | 2/1994 | Perez et al. | 340/539 |
| 5,307,763 | A | | 5/1994 | Arthur et al. | 119/718 |
| 5,337,041 | A | | 8/1994 | Friedman | 340/573 |
| 5,461,365 | A | | 10/1995 | Schlager et al. | 340/573 |
| 5,510,771 | A | | 4/1996 | Marshall | 340/573 |
| 5,512,879 | A | | 4/1996 | Stokes | 340/573 |
| 5,557,259 | A | | 9/1996 | Musa | 340/573 |
| 5,570,080 | A | | 10/1996 | Inoue et al. | 340/553 |
| 5,589,819 | A | * | 12/1996 | Takeda | 340/571 |
| 5,617,074 | A | | 4/1997 | White | 340/573 |
| 5,629,678 | A | | 5/1997 | Gargano et al. | 340/573 |
| 5,640,147 | A | | 6/1997 | Chek et al. | 340/573 |
| 5,661,460 | A | | 8/1997 | Sallen et al. | 340/573 |
| 5,689,240 | A | | 11/1997 | Traxler | 340/573 |
| 5,808,548 | A | * | 9/1998 | Sasagawa et al. | 340/571 |
| 5,812,056 | A | | 9/1998 | Law | 340/573 |
| 5,825,291 | A | | 10/1998 | Platt et al. | 340/572 |
| 5,841,352 | A | | 11/1998 | Prakash | 340/573 |
| 5,848,576 | A | | 12/1998 | Colaianni | 119/770 |
| 5,864,290 | A | * | 1/1999 | Toyomi et al. | 340/572 |
| 6,195,009 | B1 | * | 2/2001 | Irizarry et al. | 340/573.4 |

* cited by examiner

MONITORING DEVICE ADAPTED FOR USE WITH AN ELECTRONIC ARTICLE SURVEILLANCE SYSTEM

CROSS-REFERENCE TO RELATED APPLICATIONS

This is a Continuation-In-Part of application Ser. No. 09/439,689, filed Nov. 15, 1999, now U.S. Pat. No. 6,195,009.

BACKGROUND OF THE INVENTION

1. Field of the Invention

The present invention relates to a system and method for monitoring the departure of a person, such as an infant or mentally disturbed patient from a hospital, a child from a day-care center, or other vulnerable person from an area having an electronic article surveillance system.

2. Description of the Prior Art

Systems for monitoring the exit of infants from hospital maternity wards, or wandering elderly from care facilities are known. Also known are systems for monitoring inmates. Problems presented by the propensity of children to wander and become lost have been the subject of much investigation. Numerous devices have been disclosed over the years to tackle these problems. U.S. Pat. No. 5,848,567 to Colaianni discloses a leash adapted to attach a child to the guardian. U.S. Pat. No. 5,510,771 to Marshall employs a cable that alarms if it is broken. These devices put sever limitations on the mobility of child and guardian. U.S. Pat. No. 4,694,284 to Leveille et al. transmits an alarm signal when a collar is removed from a child. U.S. Pat. No. 5,617,074 to White discloses a button having a transmitter and adapted to be attached to a child's clothing or wrist strap. The button actuates an alarm if it is tampered with. Such devices may help deter abduction, but provide a less than satisfactory solution to the problem presented by a wondering child.

Generally, electronic devices designed either to monitor children within an enclosed area, or within the framework of an individual system. In the first case, the system alarms when the child leaves the monitored area. In the second case, the child wears a tag and the guardian carries a control unit. When the child strays too far from the unit, the distance between the two causes the sounding of an alarm carried by either or both of the control unit and the tag.

U.S. Pat. No. 5,337,041 to Friedman employs a tag worn by a child and adapted to be triggered by the guardian to sound an alarm when the child is out of sight. U.S. Pat. No. 5,307,763 to Arthur et al. places a loop antenna around the border of an area appointed for confinement of a child and tag alarms adapted to be worn by a child when appointed for transport outside the protected area. This device is expensive, requiring purchase of a monitoring system and wiring of an entire monitored area. U.S. Pat. No. 5,640,147 to Chek et al. discloses a tag adapted to be worn by a child. The tag is provided with a microphone and transmitter, which enables a parent to listen in and thereby monitor the child's activity. These devices may help deter abduction, but they fail to solve the problem presented by the wondering child.

Numerous devices are adapted to trigger an alarm when a battery-powered tag worn by the child exceeds a predetermined distance from a transmitter carried by the guardian. Representative of these devices are those disclosed by: DE Patent 19,608,348 to Whitehurst; U.S. Pat. No. 5,841,352 to Prakash, U.S. Pat. No. 5,661,460 to Budzyna et al.; WO Patent 9,618,913 to Budzyna et al.; WO Patent 9,627,173 to Campana; WO Patent 9,614,625 to Edwards; U.S. Pat. No. 5,512,879 to Stokes; WO Patent 9,607,998 to Gerstenberger et al.; GB Patent 2,279,170 to Newton; U.S. Pat. No. 5,289,163 to Perez et al.; GB Patent 2,248,331; U.S. Pat. No. 4,899,135 to Gharariiran; U.S. Pat. No. 5,557,259 to Musa; U.S. Pat. No. 5,461,365 to Baringer et al. FR 2704345 to Gadi; GB Patent 2,276,025 to Bartwell; FR Patent 2,674,351 to Dal Bo et al; FR Patent 2,608,868 to Estienne; WO Patent 8,706,748 to Corwin et al.; GB2182183 to Garrett et al.; U.S. Pat. No. 4,598,272 to Cox; FR Patent 2,543,715 to Mayer; DE Patent 3,215,942 to Fuchshuber; GB Patent 1,496,945; U.S. Pat. No. 5,6890240 to Traxler; and U.S. Pat. No. 5,812,056 to Law. Retail stores oftentimes generate large amounts of electronic noise. Such noise typically emanates from point of sale equipment and electronic article surveillance systems. Representative of these systems is the anti-pilferage tag system disclosed by U.S. Pat. No. 4,992,776 to Crossfield. These devices frequently exhibit extreme performance variability with differing electronic noise environments. U.S. Pat. No. 5,629,678 to Gargano et al. employs a tag that is implanted in the child; and which has obvious shortcomings. In each of these devices there is imposed an additional restriction that impedes the performance thereof. The additional restriction requires that the store install special monitoring equipment or that the guardian carry a monitoring unit.

Additional variations of a child monitoring system have been disclosed. British Patent 2,291,303 to Duffy provides direction to a transmitter worn by the child. In U.S. Pat. No. 4,785,291, the tone changes with distance changes. U.S. Pat. No. 5,119,072 to Hemingway discloses a weak signal alarm with a microphone. U.S. Pat. No. 5,021,794 to Lawrence uses transmitter/receiver and works through the cellular phone system. GB Patent 2,218,245 to Hoyle et al. discloses a device that protects babies from unauthorized removal from a hospital. GB Patent 2,248,330 to Seeman uses infrared or sonic signals. WO Patent 8,703,404 to Royoux has LEDS indicating direction and distance. In each of these devices there is imposed the further requirement that the store install special monitoring equipment or the guardian carry a monitoring unit.

EP Patent 323,041 to Newman et al. uses a magnetic strip in a wrist or ankle strap to protect against unauthorized removal of an infant. This is one of the technologies used in electronic article surveillance (EAS) systems. Numerous EAS patents exist that employ a magnetic strip. Representative of these EAS patents is U.S. Pat. No. 4,553,136 to Anderson, et al. Unfortunately, devices utilizing EAS technology have a very short detection range, typically three feet, and suffer from a low detection rate. Such systems are also susceptible to false alarms.

When EAS systems are used, markers are attached to articles, such as computers, to be protected. The markers are responsive to an electromagnetic field generated at the facility's exit by the EAS system's transmitter. Each marker must be removed or deactivated before an article to which it is affixed leaves the facility. Otherwise, upon exiting the facility, the marker disturbs the field. This disturbance is detected by the EAS system, and an alarm is triggered. U.S. Pat. No. 4,510,489 discloses a technology used in EAS systems that have been employed in retail stores to protect against shoplifting, office buildings to protect against equipment theft, hospitals to protect infants from unauthorized removal, and elderly care facilities to secure wandering patients. EAS markers are generally inexpensive and operate as a passive device, without their own power. As a result, the operating range of EAS markers is limited and their detection rate, though acceptable for some applications, is much too low to assure protection of people.

Implementation of a person monitoring system within a facility in the conventional way would require the facility to purchase and maintain a system. If the facility already possessed an EAS system, it would have to maintain both systems. This is a costly solution. The shear number of teachings directed to these monitoring systems and the conspicuous absence from the marketplace of systems for monitoring the departure of persons from facilities such as hospitals, retail sales establishments and the like, strongly suggests that the problem remains to be solved.

Accordingly, there remains a need in the art for a cost-effective system that exhibits an extremely high detection rate and which accurately and reliably monitors and protects against the unauthorized departure of persons from hospitals, stores, day care centers, bus and train stations, airports, office buildings and other facilities.

SUMMARY OF THE INVENTION

The present invention provides a system and method for monitoring the departure of a person from a facility or other area wherein an electronic article surveillance system has previously been installed or is appointed to be installed. The invention can be used to monitor day-care centers, juvenal detention centers and psychiatric facilities. It is especially suited for use in hospitals or care facilities to monitor the whereabouts of newborns, the elderly, or emotionally disturbed residents or patients. The invention provides protection for a broad range of vulnerable persons such as children, or having an infirmity, such as a mentally disturbed patient, an Alzheimer's patient, and the like. Additionally, the invention can be used to monitor low risk inmates of detention centers. Dual alarm capability is preferably provided, by sounding of alarms at the exit and within the tag worn by the exiting person.

Many facilities currently have electronic article surveillance systems for protecting against equipment theft, and more buildings are employing them every year. The present invention is especially suited for and leverages the use of these electronic article surveillance systems by adding thereto person-monitoring functionality.

Generally stated, the present invention provides a tag for monitoring the departure of a vulnerable or at-risk person from an exit having an electronic article surveillance system, comprising an antenna means for receiving an electromagnetic field generated by the electronic article surveillance system, an alarm means for sounding an alarm, a detecting means for detecting the electromagnetic field, the detecting means causing the alarm means to sound an alarm upon detection of the electromagnetic field, a power means, for powering the tag, a housing means for encasing the antenna means, the detecting means, the alarm means, and the power means, and an attaching means for attaching the housing means to the person.

The tag further comprises a generating means for generating a signal mimicking an electronic article surveillance marker, and a switching means for switching the antenna between the detecting means and the generating means, whereby upon detection of the electromagnetic field, the detecting means causes the alarm means to sound an alarm and the switching means to connect the antenna to the generating means causing the electronic article surveillance system to alarm.

Still further, the invention provides a method for detecting the departure of a person from an exit provided with an electronic article surveillance system, comprising the steps of: (a) attaching a tag to the person, the tag being responsive to the electromagnetic field generated by the electronic article surveillance system at the exit; receiving the electromagnetic field; and sounding an alarm on the tag, the alarm being triggered by departure of the person from the exit. The method further comprises the step of sounding the alarm of the electronic article surveillance system upon departure from the exit of a person to which the tag is attached.

In another embodiment of the invention, the tag comprises: a first passive marker having an elongated axis; and a second passive marker having an elongated axis, where the elongated axis of the first passive marker is fixed in a position substantially perpendicular to the elongated axis of the second passive marker.

Advantageously, the present invention leverages a store's preexisting EAS system by adding thereto a person monitoring functionality. Stores without EAS systems can obtain the benefits of the theft protection and person monitoring functions by employing this invention. In addition, the method and apparatus of the invention are much more cost effective, efficient, and reliable than devices wherein the person monitoring function is approached in the conventional way.

BRIEF DESCRIPTION OF THE DRAWINGS

The invention will be more fully understood and further advantages will become apparent when reference is made to the following detailed description of the preferred embodiment of the invention and the accompanying drawings, in which:

FIG. 4(*b*) is a side view of the tag of FIG. 2*a*, showing a pin and portion of the garment;

FIG. 5(*b*) is a side view of the tag of FIG. 3*a* showing the wrist strap, locking means, and pin.

DESCRIPTION OF THE PREFERRED EMBODIMENTS

A significant number of retail stores presently utilize electronic article surveillance systems, and more stores and store chains are employing them every year. The present invention leverages the extant use of EAS systems by adding thereto person-monitoring functionality.

Many retail stores employ EAS systems to protect against theft. Conventional EAS systems comprise a transmitter for generating an electromagnetic field at the exit of a retail establishment, a marker attached to an article to be protected from theft, and a receiver. The marker is responsive to the electromagnetic field. It is designed to be removed or deactivated before the article leaves the store. Otherwise, upon exit of the article, the marker disturbs the field. The disturbance is detected by the receiver and the EAS system'alarm is triggered.

Optionally, the invention can be used to monitor day-care centers, juvenal detention centers, psychiatric facilities, in hospitals or care facilities for the protection of newborns, the elderly, or emotionally disturbed residents or patients.

Figure 1:
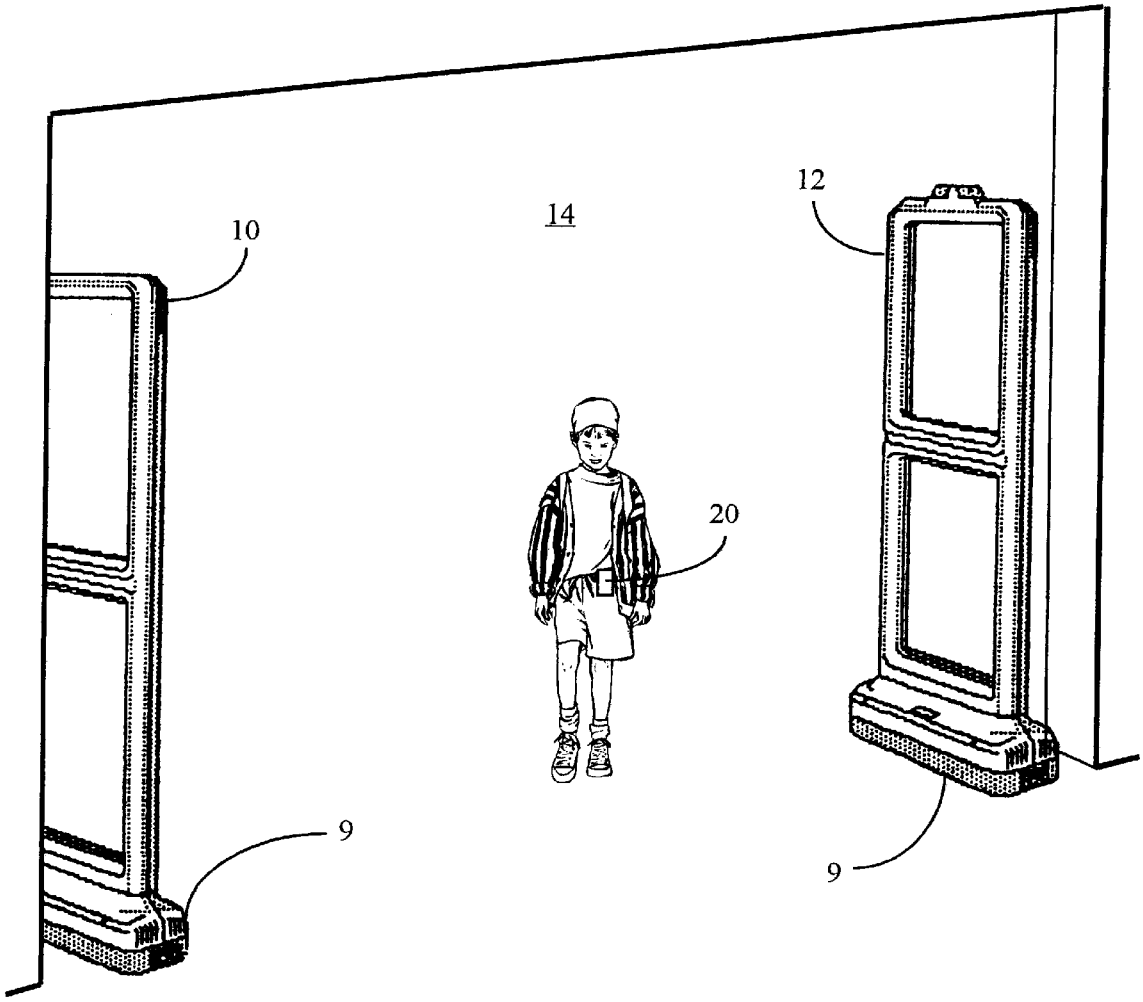
FIG. 1 is a perspective view of a person to which there is attached a tag of the invention, the person being shown to be entering an electronic article surveillance system.

Referring to FIG. 1 of the drawings, there is shown an apparatus for monitoring the departure of a person from an exit. Electronic article surveillance system 9 comprising transmitter 10 and receiver 12 is set across exit 14. Transmitter 10 generates an electromagnetic field at exit 14; and tag 20, worn by a person, is responsive to the electromagnetic field causing tag 20 to alarm on departure of the person from exit 14. Optionally, tag 20 is provided with means for alarming receiver 12.

Figure 2:
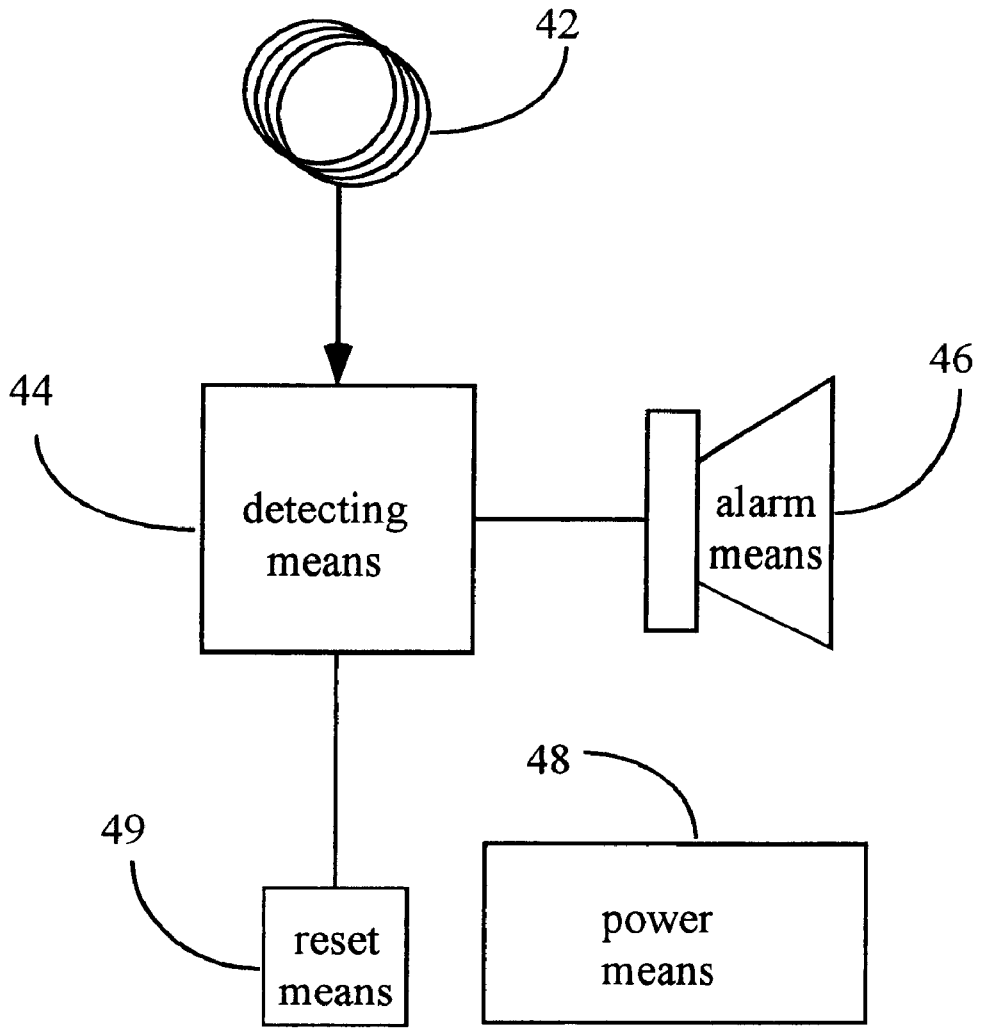
FIG. 2 is a schematic view of tag electronics.

Referring to FIG. 2, tag 20 comprises antenna means 42 for receiving the electromagnetic field generated by electronic article surveillance system 9; alarm means 46 for sounding an alarm; detecting means 44 for detecting the electromagnetic field, the detecting means 44 causing alarm means 46 to sound an alarm upon detection of the electromagnetic field; power means 48, for powering tag 20; and housing means for encasing antenna means 42, detecting means 44, alarm means 46, and power means 48.

Antenna means 42 consists of a coil of wire and a capacitor tuned at the operating frequency of EAS system 9. Preferably, alarm means 46 is a piezoelectric or electromagnetic speaker. Detecting means 44 receives and identifies the field generated by transmitter 10 and is known in the art. Power means 48 is a battery, preferably a rechargeable type.

Figure 3:
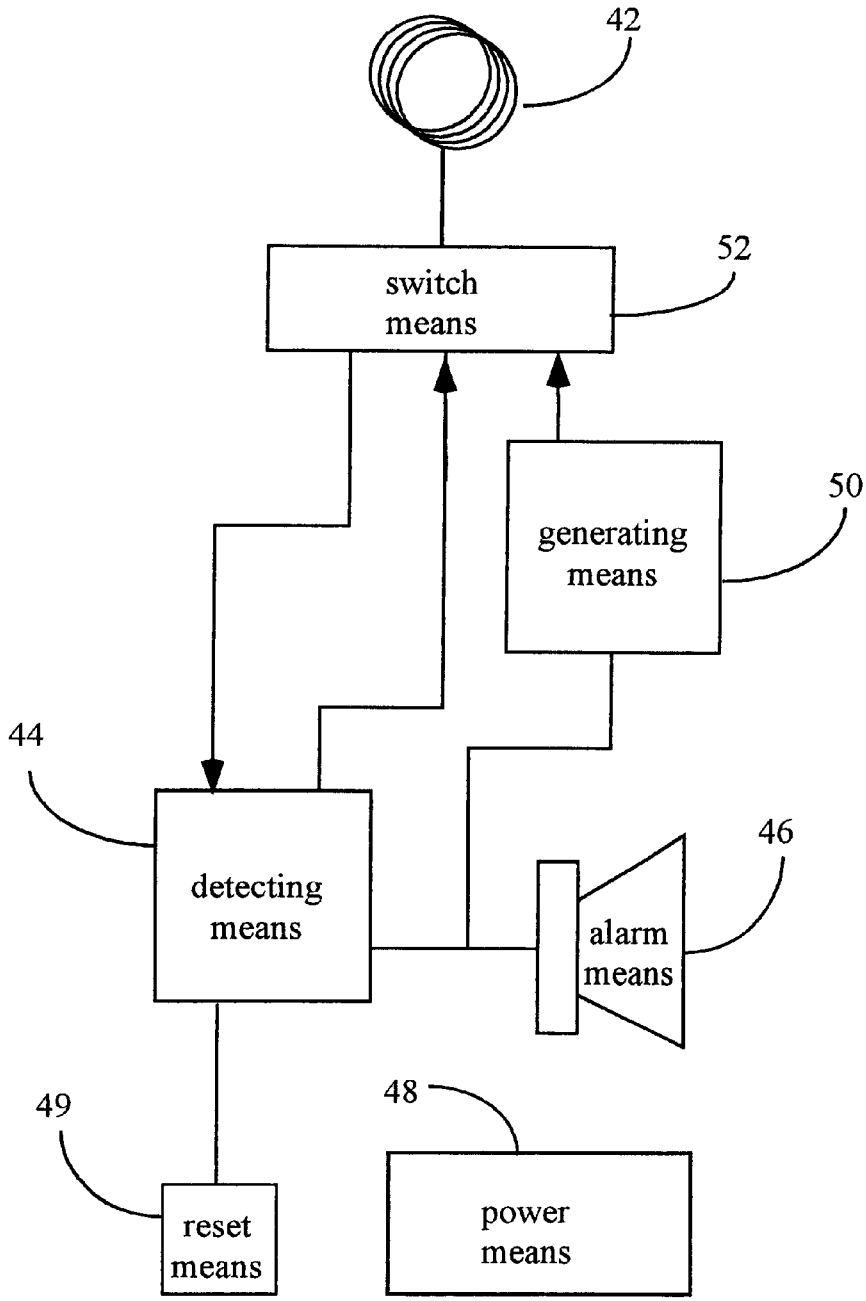
FIG. 3 is a schematic view of an alternative embodiment of tag electronics.

Optionally, as shown in FIG. 3, tag 20 further comprises: generating means 50 for generating a signal mimicking an electronic article surveillance marker; and switching means 52 for switching antenna means 42 between detecting means 44 and generating means 50. Upon detection of the electromagnetic field, detecting means 44 causes alarm means 46 to sound an alarm and switching means 52 to connect antenna means 42 to generating means 50 causing electronic article surveillance system 9 to alarm.

As used herein, the term "mimicking" means that upon receiving the electromagnetic field generated by electronic article surveillance system 9, tag 20 will generate a signal that substantially reproduces the preselected disturbance in the electromagnetic field caused by the marker of the electronic article surveillance system. For example, markers associated with magnetomechanical EAS systems, as taught in U.S. Pat. No. 4,553,136 to Anderson, et al., typically have signals comprised of decaying 60 kHz oscillations. Generating means 50 of tag 20 would, in this example, be comprised of a discharging RC circuit. There are many alternative ways known in the art for reproducing such a signal.

As a further option, tag 40 comprises resetting means 49 for resetting the alarm. Generating means 50 is a controlled oscillator generating a modulated carrier wave. The carrier wave frequency is that of transmitter 10 and the modulation mimics the anti theft marker of EAS system 9. Preferably, resetting means 49 is a momentary switch.

Alternatively, switching means 52 is eliminated and generating means 50 and detecting means 44 are both directly connected to antenna means 44. In this embodiment, the output impedance of generating means 50 needs to be sufficiently high that antenna means 42 does not appear as a short circuit to detecting means 44, but is low enough to allow sufficient signal from generating means 50 to couple to antenna means 42.

The invention further encompasses a method for detecting the departure of a person, from exit 14 provided with an electronic article surveillance system 9, comprising the steps of: attaching tag 20 to the person, tag 20 being responsive to the electromagnetic field generated by electronic article surveillance system 9 at exit 14; receiving of the electromagnetic field; and sounding an alarm on tag 20.

Optionally, the method of this invention further comprises the step of sounding the alarm of electronic article surveillance system 9 upon departure of the person from exit 14.

Figure 4A:
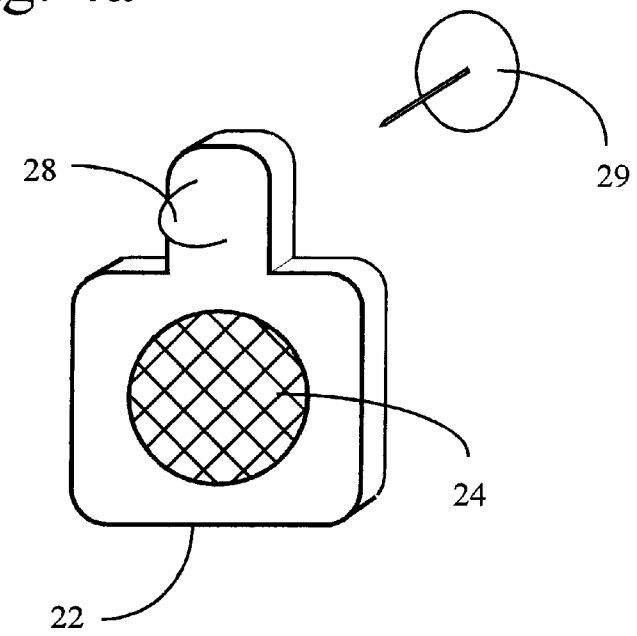
FIG. 4(*a*) is a perspective view of the front of a tag appointed for attachment to a person's garment.
Figure 4B:
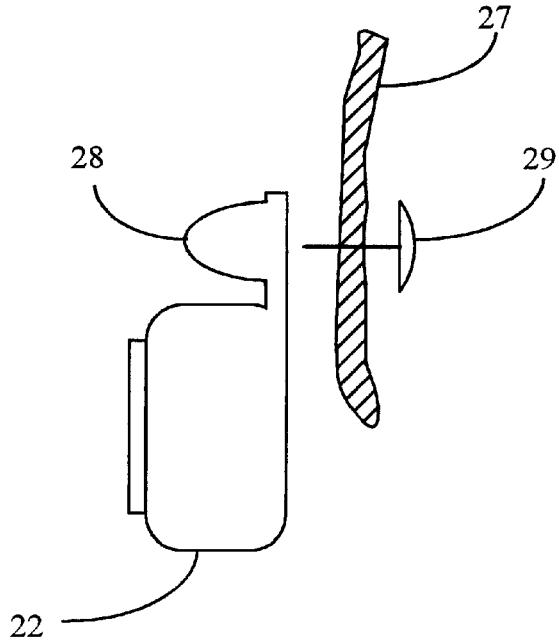

As shown in FIGS. 4(*a*) and 4(*b*), tag 20 is housed in housing 22 and has opening 24 for alarm means 46. Preferably, tag 20 is provided with locking means 28 for receiving pin 29. Locking means 28 and pin 29 are known in the art for attaching EAS markers to clothing or other soft goods. Tag 20 is secured to garment 27 by pin 29 and locking means 28.

Figure 5A:
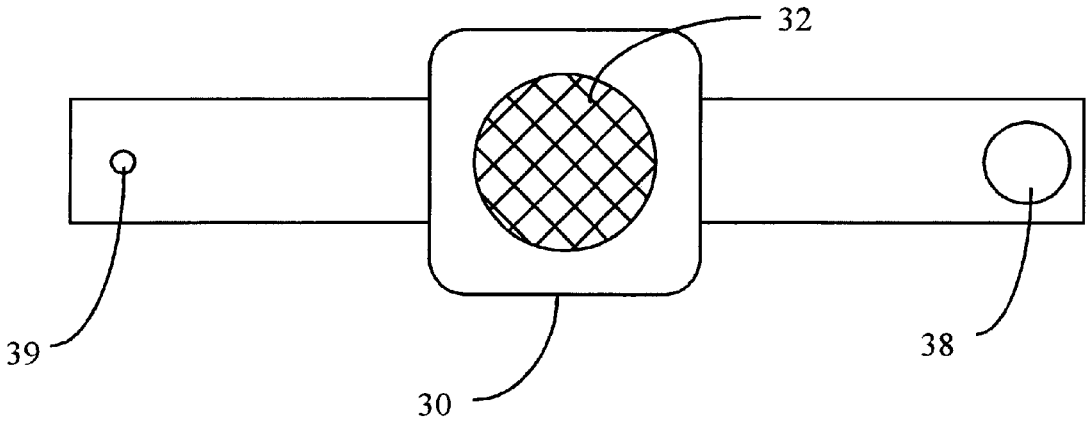
FIG. 5(*a*) is a top view of a tag with a wrist strap, locking means, and pin appointed for securing the tag to a person's wrist.
Figure 5B:
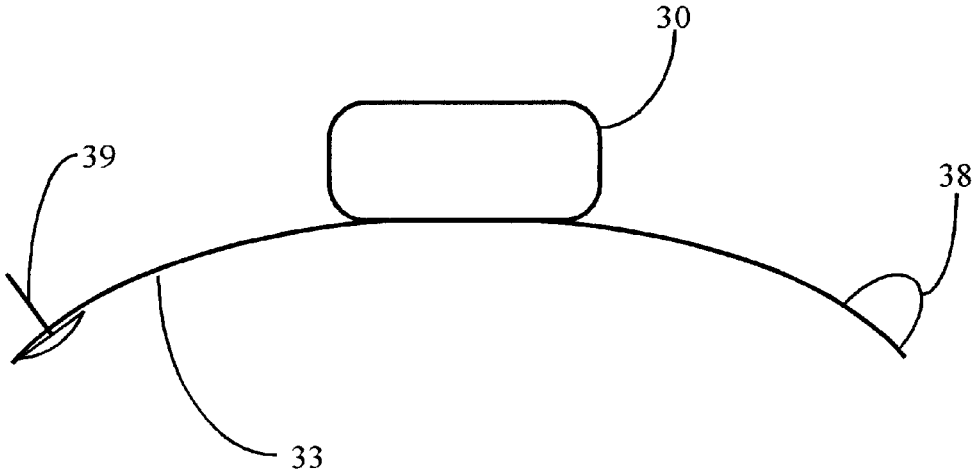

Alternatively, as shown in FIGS. 5 and 5(*b*) tag 20 is housed in housing 30 and has opening 32 for alarm means 46. Preferably, tag 20 is provided with locking means 38 for receiving pin 39. Locking means 38 and pin 39 are known in the art for attaching EAS markers to clothing or other soft goods. Tag 20 is secured, to the wrist or ankle of the person, using strap 33.

Figure 6:
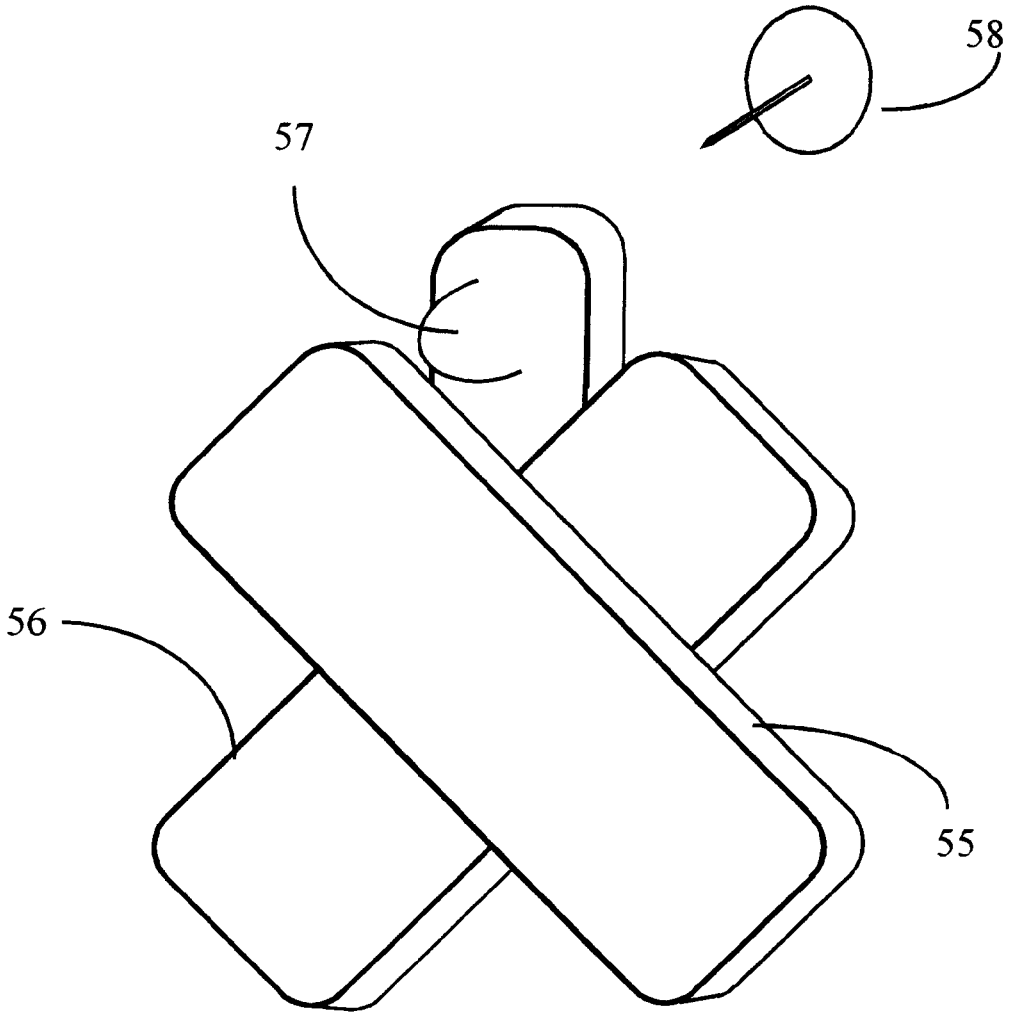
FIG. 6 is a perspective view of a tag constructed from two electronic article surveillance system markers.

In another embodiment of the invention, shown in FIG. 6, the marker of EAS system 9 is modified for use in a person monitoring system. Tag 51 comprises; first passive marker 55 having an elongated axis; and second passive marker 56 having an elongated axis; whereby the elongated axis of first passive marker 55 is fixed perpendicular, or near perpendicular, to the elongated axis of second passive marker 56. EAS markers have preferred orientation with respect to the EAS system for best detection. By adding a second marker at a different orientation, the detection rate of an ordinary EAS marker is significantly enhanced to yield tag 51.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. An apparatus for monitoring movement of a person through an exit, comprising:

a. an electronic article surveillance system for generating an electromagnetic field at said exit and detecting a preselected disturbance in said electromagnetic field produced by passage of an article surveillance system tag therethrough; and b. a tag worn by said person, said tag being powered by a battery and having an alarm means responsive to said electromagnetic field, and generating a mimicking signal that reproduces said preselected disturbance, said mimicking signal having a frequency equal to the frequency of said electromagnetic field that causes said article surveillance system tag to produce said preselected disturbance; whereby said tag will alarm and trigger said electronic article system alarm on departure of said person from said exit.

2. A tag adapted to be worn by a person, for monitoring the movement of the person through an exit having an electronic article surveillance system that generates an electromagnetic field at said exit and detects a preselected disturbance in said electromagnetic field produced by passage of an article surveillance system tag therethrough, comprising:

a. antenna means for receiving the electromagnetic field generated by said electronic article surveillance system;

b. alarm means for sounding an alarm;

c. detecting means for detecting said electromagnetic field, said detecting means causing said alarm means to sound an alarm upon detection of said electromagnetic field;

d. power means including a battery for powering said tag;

e. housing means for encasing said antenna means, said detecting means, said alarm means, and said power means; and f. attaching means for attaching said housing means to said person; said tag further comprising:

g. generating means responsive to said electromagnetic field for generating a mimicking signal that reproduces said preselected disturbance, said mimicking signal having a frequency equal to the frequency of said electromagnetic field that causes said article surveillance system tag to produce said preselected disturbance; and h. switching means for switching said antenna between said detecting means and said generating means, whereby upon detection of said electromagnetic field, said detecting means causes said alarm means to sound an alarm and said switching means to connect said antenna to said generating means, causing said electronic article surveillance system to alarm.

3. A tag as recited by claim 2, further comprising resetting means for resetting said alarm.

4. A tag as recited by claim 2, wherein said battery is rechargeable.

5. A tag as recited by claim 2, further comprising:

a. generating means for generating a signal from an electronic article surveillance marker; and b. transmitting antenna means for transmitting said mimicking signal, whereby upon detection of said electromagnetic field, said detecting means causes said alarm means to sound an alarm and said generating means to generate said signal to said transmitting antenna means causing said electronic article surveillance system to alarm.

6. A tag as recited by claim 2, wherein said person is a vulnerable person.

7. A tag as recited by claim 2, wherein said person has an infirmity.

8. A tag as recited by claim 7, wherein said person has a mental disability.

9. A tag as recited by claim 8, wherein said person is a hospital patient.

10. A tag as recited by claim 8, wherein said person is an Alzheimer's patient.

11. A tag as recited by claim 2, wherein said person is a low risk inmate of a detention center.

12. A method for detecting the movement of a person through an exit provided with an electronic article surveillance system that generates an electromagnetic field at said exit and detects a preselected disturbance in said electromagnetic field produced by passage of an article surveillance system marker therethrough, comprising the steps of:

a. attaching to said person a tag responsive to the electromagnetic field generated by said electronic article surveillance system at said exit;

b. receiving said electromagnetic field; and c. sounding an alarm on said tag in response to application of said electromagnetic field and generating a mimicking signal that reproduces said preselected disturbance, thereby triggering an alarm on said electronic article surveillance, said mimicking signal having a frequency equal to the frequency of said electromagnetic field that causes said article surveillance system tag to produce said preselected disturbance.

13. A tag as recited by claim 12, wherein said person is a vulnerable person.

14. A tag as recited by claim 12, wherein said person has an infirmity.

15. A tag as recited by claim 14, wherein said person has a mental disability.

16. A tag as recited by claim 15, wherein said person is a hospital patient.

17. A tag as recited by claim 15, wherein said person is an Alzheimer's patient.

18. A tag as recited by claim 12, wherein said person is a low risk inmate of a detention center.

* * * * *